United States Patent [19]

Eijsermans

[11] 3,991,541

[45] Nov. 16, 1976

[54] DEVICE FOR BUNDLING FLAT FLEXIBLE OBJECTS

[75] Inventor: Petrus Antonius Henricus C. Eijsermans, Hapert, Netherlands

[73] Assignee: Hapa Holland N.V. Machine-en Apparatenfabriek, Hapert, Netherlands

[22] Filed: Oct. 11, 1974

[21] Appl. No.: 514,264

[30] Foreign Application Priority Data

Oct. 15, 1973 Netherlands ..... 7314126

[52] U.S. Cl. ..... 53/124 A; 53/162; 53/198 R

[51] Int. Cl.[2] ..... B65B 13/20; B65B 63/02

[58] Field of Search ..... 53/124 A, 124 C, 198 R, 53/162, 207, 22 B; 100/3, 17, 18; 271/64; 214/6 H

[56] References Cited

UNITED STATES PATENTS

| | | | |
|---|---|---|---|
| 1,424,363 | 8/1922 | Leumann | 53/226 X |
| 2,917,881 | 12/1959 | Zachow | 53/198 R X |
| 3,162,439 | 12/1964 | Poland et al. | 271/64 |
| 3,197,200 | 7/1965 | Byrt | 271/64 X |
| 3,279,146 | 10/1966 | Ficht | 53/198 R |
| 3,331,312 | 6/1967 | Leslie et al. | 53/198 R X |
| 3,343,334 | 9/1967 | Bode et al. | 53/198 R X |
| 3,364,847 | 1/1968 | Francois | 100/17 X |
| 3,374,902 | 3/1968 | Mills | 214/6 H |
| 3,589,091 | 6/1929 | Cloud | 53/198 R X |
| 3,596,434 | 8/1971 | Zelnick | 53/198 R |
| 3,730,386 | 5/1973 | Monsees | 53/78 X |
| 3,766,708 | 10/1973 | Kubo et al. | 53/198 R |
| 3,775,940 | 12/1973 | Hatanaka | 53/212 |
| 3,866,902 | 2/1975 | Feldkamper | 271/64 |
| 3,903,673 | 9/1975 | Grasvoll | 53/228 X |

*Primary Examiner*—Travis S. McGehee
*Assistant Examiner*—John Sipos
*Attorney, Agent, or Firm*—Spensley, Horn & Lubitz

[57] ABSTRACT

A bundling machine for flat, flexible objects such as bags including conveyor means for delivering bags to a storage volume within the machine. Tape for binding the bundle is fed across the bottom of the storage volume from either side and is joined at the center. Stacking means are provided and when the desired number of bags are piled, a pair of horizontally reciprocating portions under the pile separate, allowing it to fall onto a table below, after which the reciprocating members approach one another again and the pile of bags is compressed onto the under side of the reciprocating members and the binding tape is tensioned. The tape at this stage substantially surrounds the pile, the ends passing through the small space between the reciprocating portions. The tape is severed at the point where it passes between the reciprocating members, the ends of the portion surrounding the bags being adhered to each other and the severed ends being adhered to each other.

23 Claims, 6 Drawing Figures

DEVICE FOR BUNDLING FLAT FLEXIBLE OBJECTS

The invention relates to a device for buindling flat, flexible objects, more particularly bags.

In many cases it is desirable to bundle flat, flexible objects for example for transport purposes. The present-day machines producing such flat, flexible objects for example bags, deliver per unit of time great quantities of such objects. Bundling of such objects has hitherto most been carried out by hand, which is a labour-consuming and hence expensive process. The invention has for its object to provide a simple and efficacious device for directly bundling flat objects emanating from the production machine.

According to the invention this can be achieved with the aid of a device comprising a frame, a storage arranged in said frame and comprising two horizontally reciprocatory portions, that means moving in a direction away from each other and in a direction towards each other, a table arranged beneath the storage and adapted to move up and down, two reels carrying tapes for tying up the bundles, the ends of said tapes being passed along the bottom of the storage, and collecting plates adapted to turn about a horizontal shaft and to be moved horizontally away from and towards each other, there being provided driving means for the various members so that the collecting plates are regularly turned about the horizontal shaft and arrive at a position, in which the objects are collected by the collecting plates, after which the collecting plates are moved away from one another, turned upwards and approached to one another in the upturned position, whilst when a given number of objects has been deposited in the storage the portions thereof are moved away from one another for passing the bundle of objects bearing on the previously interconnected ends of the tapes, the portions of the storage are approached to one another again and the bundle is urged by the lifting table against the bottom side of the storage, the tapes above the bundle are adhered to one another and the tape portions surrounding the bundle are cut from the further tape portions by means of adhering and cutting means secured to the portions of the storage.

It has been found that such a device permits of bundling a large number of objects in a desired number per unit of time so that the device can be arranged directly after a device for the manufacture of the objects and the objects emanating from the latter device can be bundled directly by the device embodying the invention.

The invention will now described more fully with reference to an embodiment of a device in accordance with the invention shown schematically in the accompanying figures.

Figure 1:
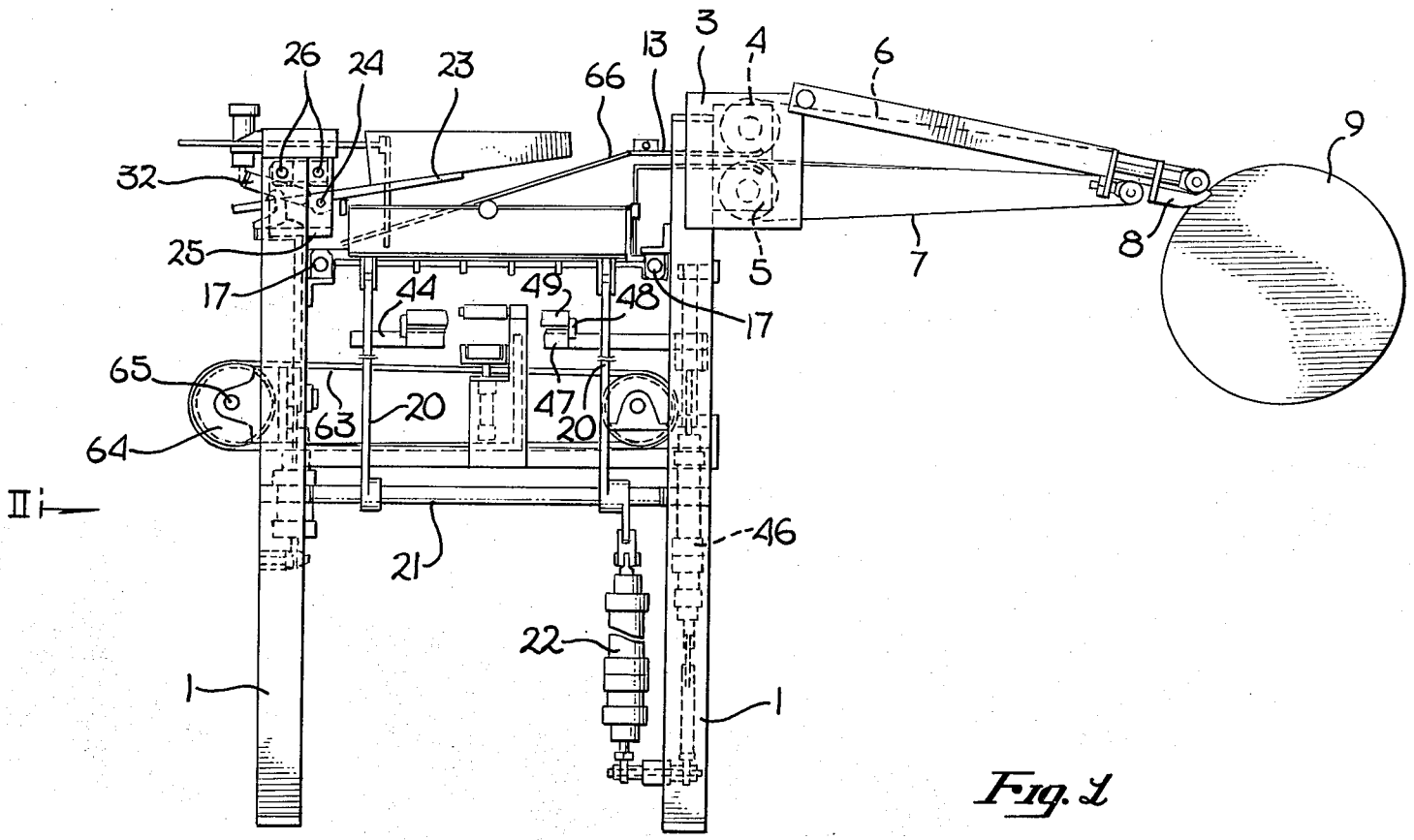
FIG. 1 shows schematically a side elevation of a device in accordance with the invention.

The device shown in the figures comprises a frame having vertical beams 1 interconnected by transverse beams 2, several beams being omitted from the figures for the sake of clarity.

On one side of the frame guide rollers 4 and 5 of superjacent endless conveyor belts 6 and 7 are arranged by means of supports 3. Near the end of the upper conveyor belt remote from the frame a pick-up tag 8 is provided, which co-operates with a drum 9, for example, of a machine producing bags, which are held on the drum by a clamping member, the clamping member being uncoupled when the drum 9 turns past the tag 8 and the bag is lifted from the drum, being passed in between the two conveyor belts 6 and 7.

Figure 3:
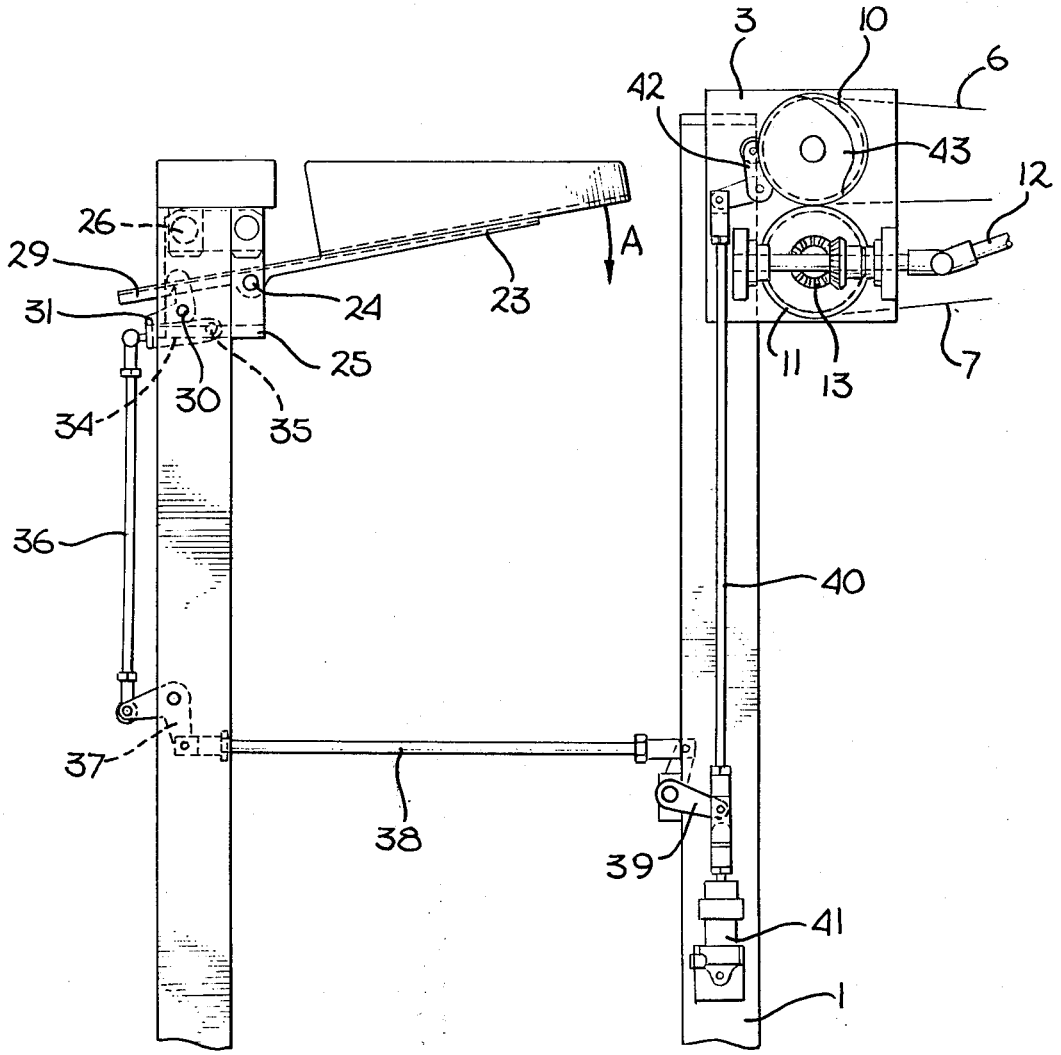
FIG. 3 shows schematically the disposition of the mechanism for turning the collecting plates.

From FIG. 3 is will appear that the two guide rollers 4 and 5 of the conveyor belts 6 and 7 are intercoupled with the aid of interengaging gear wheels 10 and 11. The gear wheel 11 is driven from a driving shaft 12 through a bevel gear wheel transmission 13. The driving shaft 12 is coupled with the machine producing the bags so that the superjacent conveyor belts 6 and 7 are driven in synchronism with the bag-producing machine so that it is ensured that at any producing rate of the machine the distance between the bags passing in between the conveyor belts is always the same.

At the level of the guide rollers 4 and 5 two horizontal guide plates 13 and 14 are arranged one above the other (FIG. 1), between which the bags pass with a comparatively high speed owing to the speed imparted to the bags by the conveyor belts 6 and 7.

Figure 2:
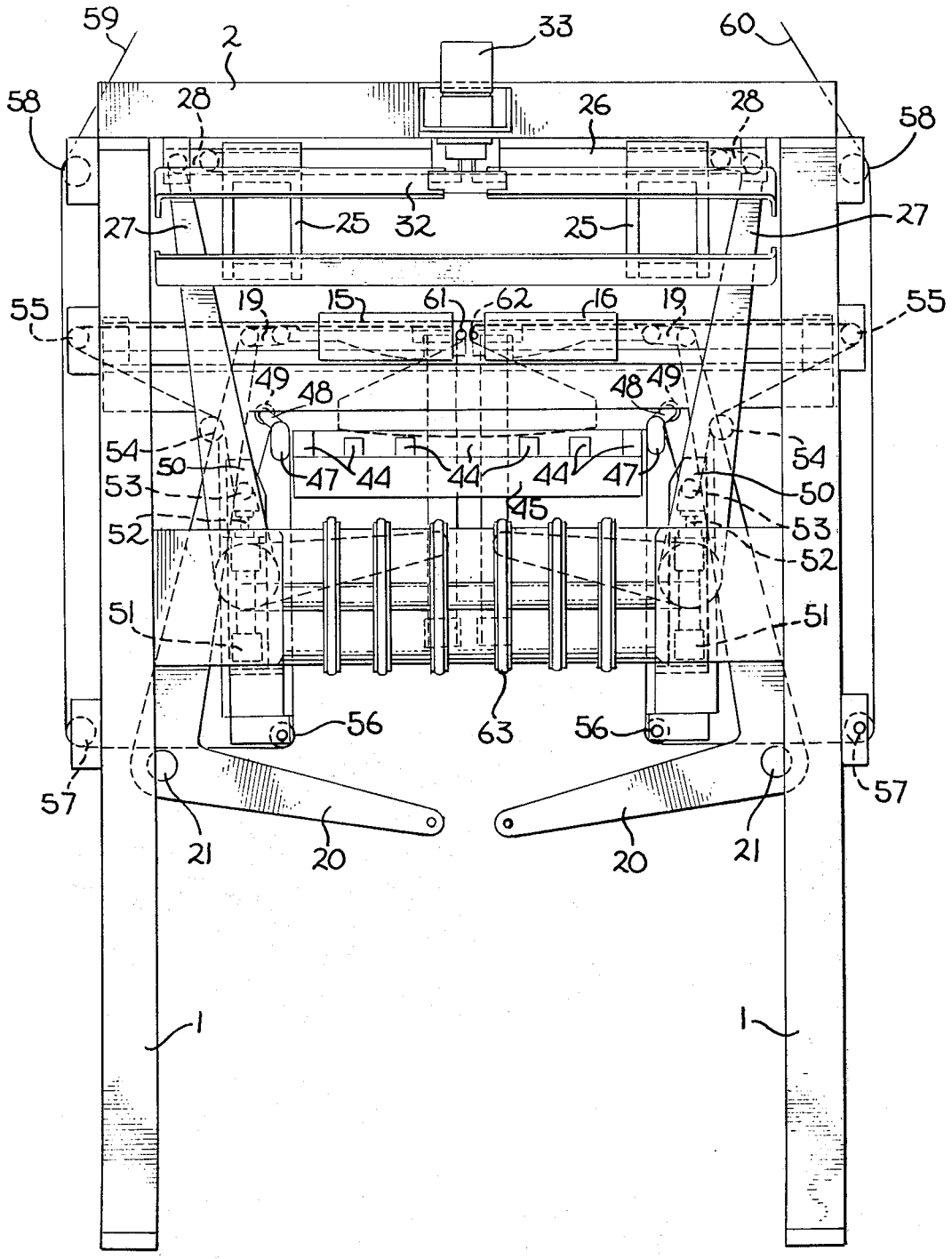
FIG. 2 is an enlarged elevation of the device shown in FIG. 1 in the direction of the arrow II in FIG. 1, various parts being omitted for the sake of clarity of the figures.

On the sides of the plates 13 and 14 remote from the conveyor belts 6 and 7 and at a given distance beneath the lower plate 14 a storage is arranged in the form of a substantially rectangular trough which is open on the top side and which is divided in two portions, viewed in the direction of movement of the belts 6 and 7 so that the storage comprises two portions 15 and 16, which are adapted to shift away from and towards one another along horizontal shats 17 extending at right angles to the direction of length of the belts 6 and 7. It should be noted that FIG. 2 only shows the lower parts of the storage portions 15 and 16. From this figure it will be apparent that beneath the bottom of the storage portions 15 and 16 vertical strips 18 are secured, which extend parallel to the shafts 17, said strips having a slightly curved shape so that the lower edges of the strips extend upwards in a slight curve away from the centre of the storage.

To strips 18 located near the ends of the storage portions are pivoted, by means of horizontal pins extending at right angles to the shafts 17, the ends of coupling members 19, the other ends of which are pivoted to the ends of arms of levers 20, which are fastened to horizontal shafts 21 extending at right angles to the shafts 17 and which shafts are journalled in the frame. The arms 20 can be turned with the aid of a setting cylinder 22 coupled with said arms and it will be apparent that a turn of the arms 20 reflects in a movement of the storage portions 15 and 16 towards or away from one another.

Above the storage 15, 16 two collecting plates 23 are arranged side by side, which are pivotally coupled with suspension blocks 25 with the aid of aligned stub shafts 24 extending parallel to the shafts 17. The suspension blocks 25 are slidable along shafts 26 extending parallel to the shafts 17. For this purpose two angle-levers 27 adapted to turn about shafts journalled in the frame are coupled with the suspension blocks 25 by means of coupling members 28. The angle-levers 27 can be turned to and fro with the aid of a setting cylinder (not shown) for moving the suspension blocks 25 towards and away from one another.

On the sides of the stub shafts 24 remote from the collecting plates 23 strips 29, extending parallel to the shafts 26, are rigidly secured to the collecting plates for co-operation with lock bolts 31 adapted to turn about stub shafts 30 extending parallel to the stub shafts 24. FIGS. 1 and 3 show the collecting plates 23 in the turned-up state, in which they are retained by the lock bolts 31 against the action of springs (not shown) which tend to turn the collecting plates 23 in the direction of the arrow A.

Above the strips 29 a U-shaped bracket 32 is pivoted to the frame by means of stub shafts extending parallel to the shafts 26. With the bracket 32 is coupled the piston rod of a setting cylinder 33 fastened to the frame. Beneath the lock bolts 31 is located a U-shaped bracket 34, which is also adapted to turn with respect to the frame about stub shafts 35, extending parallel to the shafts 26. The bracket 34 is coupled by means of a coupling rod 36 with an angle-lever 37 adapted to turn with respect to the frame (FIG. 3), said lever being connected by means of a coupling rod 38 with a second angle-lever 39, connected with the frame with respect to which it is adapted to turn. From FIG. 3 it will furthermore appear that the angle-lever 39 is furthermore coupled with a coupling rod 40, one end of which is connected with the piston rod of a setting cylinder 41 fastened to the frame, the other end of the rod 40 being coupled with an arm of an angle-lever 42 adapted to turn relatively to the frame, the other arm of the angle-lever carrying a roller adapted to co-operate with a cam disc 43, which is rigidly connected with the guide roller 4 of the conveyor belt 6.

Beneath the storage is arranged a table formed by a plurality of spaced arms 44, extending parallel to the shafts 21 and having their ends fastened to a connecting member 45, which is adapted to move up and down with the aid of a setting cylinder 46 coupled with the frame. Near the sides of the table and movable with it, supporting tubes 47 are arranged, which extend parallel to the arms 44. On the top sides of the supporting tubes, rollers 49, extending parallel to the supporting tubes, are pivotally coupled thereto with the aid of arms 48. Springs (not shown) co-operating with the arms 48 tend to swing the rollers 49 outwardly, so that the rollers 49 are urged against the outside of the supporting tubes 47. The frame is provided with cams 50, with which the rollers 49 come into contact when the table 44, 45 moves downwards with the aid of the setting cylinder 46, so that the rollers 49 are turned upwards and are released from the supporting tubes 47.

On eithher side of the table 44, 45 setting cylinders 51 are arranged in the frame. To the ends of the piston rods 52 of the setting cylinders, projecting above the cylinders, are fastened freely rotatable rollers 53, extending parallel to the rollers 49.

Near the setting cylinders the frame holds further guide rollers 54 and near the sides of the frame, at the level of the plane going through the bottom of the storage, further guide rollers 55 are journalled in said frame.

Beneath the setting cylinders 51 and on either side of each setting cylinder two guide rollers 56 and 57 are journalled in the frame and above each guide roller 55 a further guide rollers 58 is journalled in the frame.

The frame holds furthermore two reels (not shown) located above the collecting plates, from which reels the ends of tapes 59 and 60 wound on them are guided along the guide rollers 58 in downward direction, along the guide rollers 57 in a horizontal direction towards the guide rollers 56, from where the tapes 59 and 60 extend upwardly along the proximal sides of the tubes 47 and in between the tubes 47 and rollers 49, after which they are guided below the rollers 53 and along the guide rollers 54 and 55 in a horizontal direction towards one another along the bottom of the storage portions 15 and 16. The facing edges of the storage portions 15 and 16 have fastened to them adhering and cutting means, formed in this embodiment, in which the tapes 59 and 60 are made of synthetic resin, by a pressing roller 61 and a pressing strip 62 capable of adhering the ends of the tapes to one another by heat and of cutting the tapes between the ends of the interconnected portions.

Beneath the upwards and downwards reciprocatory table an endless conveyor belt is formed by a plurality of spaced belts 63 guided around pulleys 64, fastened to shafts 65, journalled in the frame and extending parallel to the shafts 17 and driven in a manner not shown. The belts 63 and the pulleys 64 are arranged so that the arms 44 can move downwards in between the belts 63 and the pulleys 64 so that the top sides of the arms 44 arive below the top sides of the upper runs of the belts 63.

From FIG. 1 it will furthermore be apparent that the top plate 13 has pivoted to it the end of a guide wire 66 so that the wire is inclined in the direction of movement of the supplied objects or bags down into the storage.

The device depicted above operates as follows.

When the process starts the ends of the tapes 59 and 60 lying on the bottom of the storage are sticking to one another. The table 44 is in its lowermost position so that the rollers 49 are free of the guide tubes 47. The collecting plates 23 are in the position shown in figure and the roller held by the angle-lever 42 is free of the cam disc 43.

As stated above the conveyor belts 6 and 7 are driven in synchronism with the bag-producing machine so that the bags emanate regularly at equal intervals from the roller 9 of the machine, are conveyed between the conveying belts 6 and 7 to the left, viewd in FIG. 1, and are inserted at a comparatively high rate between the plates 13 and 14 so that the bags shoot into the storage 15, 16, where they are guided by the guide wire 66 in downward direction so that the bags are piled upon the storage 15, 16. With the aid of a counting mechanism (not shown), which is also driven by the bag-producing machine the number of delivered bags is counted and when the desired number of bags has been supplied to the storage, a pneumatic switch (not shown) is actuated by said counting mechanism so that the pneumatic setting cylinder 41 is enabled to push the rod 40 upwards so that the roller carried by the angle-lever 42 is urged against the periphery of the cam disc 43. During its movement along the circumference of the cam disc 43 the roller carried by the angle-lever 42 will move at a given instant over a comparatively large distance towards the rotary shaft of the cam disc 43 so that the rod 40 moves upwards (FIG. 3), the rod 38 is urged to the left so that the rod 36 is also moved upwardly. As a result the bracket 34 will turn the lock bolts 31 about the stub shafts 30, the lock bolts being thus released from the strips 29 and the collecting plates 23 are pivoted under the action of the springs (not shown) in the direction of the arrow A until the strips 29 come into contact with the lower side of the bracket 32. Thus the collecting plates get into a position such that the additionally supplied bags are collected on the collecting plates 23. As soon as the collecting plates 23 have attained a position suitable for receiving the bags, the storage portions 15 and 16 are moved away from one another by means of the pneumatic setting cylinder 22 and the levers 20 so that the adhering ends of the tapes 59 and 60 with the bundle of bags will move downwards in between the storage portions 15 and 16, the ends of the tapes 59 and 60 with the bundle then bearing on the table 44. As soon as the bundle of bags has sunk below the storage portions 15 and 16, the latter are moved towards one another by means of the setting cylinder 22 into a position in which the facing edges of the storage portions 15 and 16 are spaced apart by about 1 cm. Subsequently the table holding the bundle of bags is urged upwards so that the bundle of bags is clamped between the top side of the table 44 and the lower side of the storage portions 15 and 16. Owing to the curved shaped of the bottom side of the storage portions 15 and 16 and to the matching shape of the table 44 the bundle is slightly bent around its longitudinal axis. During the upward movement of the table 44 the rollers 49 are released from the cams 50 and are clamped by means of springs (not shown) against the tubes 47 so that the tapes 59 and 60 are retained at the area of the rollers 49, as a result of which at the upward movement of the table the ends of the tapes 59 and 60 located in the storage portions are withdrawn and the tapes are stretched taut about the bundle of bags.

In order to avoid an excessive tension in the tapes 59 and 60 a given pressure is adjusted in each pneumatic setting cylinder 51 on the side of the piston rod with the aid of a reducing valve (not shown) communicating with said side of the setting cylinder. When the force exerted on the tape 59 or 60 exceeds a given value, air can escape through the discharge valve of the reducing valve from the setting cylinder 51 concerned so that the guide roller 53 held by said setting cylinder 51 can also move slightly upwards.

As soon as the table 44 reached its topmost position, the storage portions 15 and 16 are further approached to one another by the setting cylinder 22 so that the ends of the tapes 59 and 60 are clamped tight between the pressing roller 61 and the pressing strip 62, after which they are adhered to one another by means of an electrically heated wire arranged in the pressing strip 62, after which they are cut in between the welds made. The table 44 remains in its topmost position for a minute whilst air is blown through channels (not shown) in the bottom of the storage along the welds for cooling purposes. Subsequently the storage portions are moved slightly away from one another for releasing the bundle of bags, after which the table 44 is moved downwards until the top sides of the arms are located below the top sides of the top runs of the belts 63 so that the bundle of bags can be transported by means of the conveyor belts 63.

After the storage portions 15 and 16 have moved towards one another after having allowed a bundle of bags to pass down, the suspension blocks 25 with the collecting plates 23 secured thereto are moved away from one another with the aid of the angle-levers 27 so that the bags collected on said plate again drop into the storage 15, 16 and a new bundle can be accumulated in the storage. After the bags have dropped from the plates 23, the plates are turned upwards with the aid of the reset bracket 32, which is moved by the setting cylinder 33, about the stub shafts 24 so that the lock bolts 31 can again grasp behind the strips 29. This is enabled because the bracket 34 with the members coupled herewith has returned to the original position. After the upward turn of the plates 23 the pressure in the setting cylinder 33 disappears so that the bracket 32 can return to the position shown in the figure by the action of a spring (not shown). The plates 23 with the suspension blocks 25 are again moved towards each other with the aid of the levers 27 so that the cycle described above can be repeated.

It will be obvious that in this way a bundling machine operating in synchronism with the bag-producing machine is obtained, which permits of bundling the bags in a rapid and efficacious manner in accordance with the rate of production.

Although in the foregoing reference is made mainly to bundling bags, it will be obvious that the machine may also be employed for bundling other flat, flexible objects.

Figure 4:
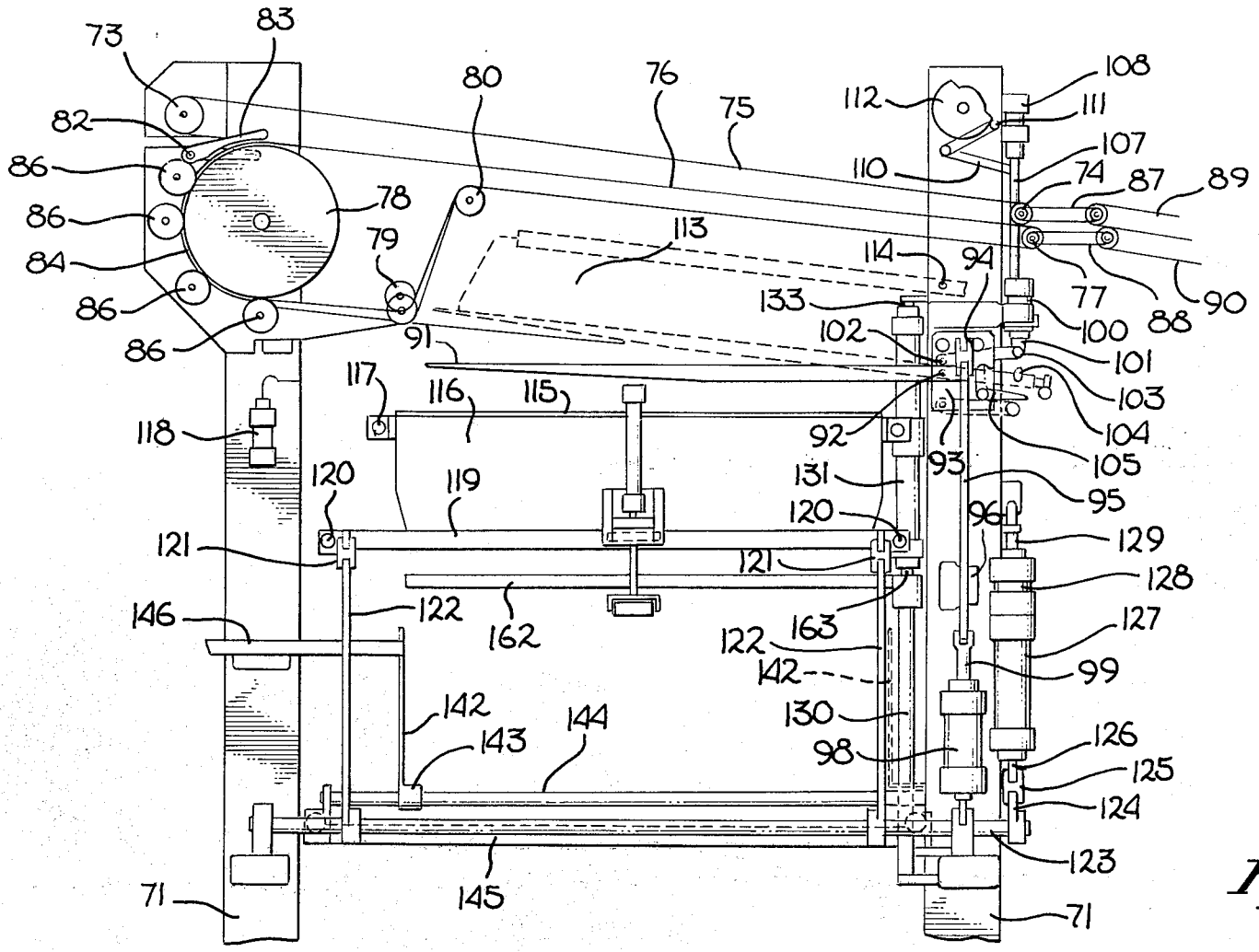
FIG. 4 is a schematic side elevation of a second embodiment of a device in accordance with the invention.
Figure 5:
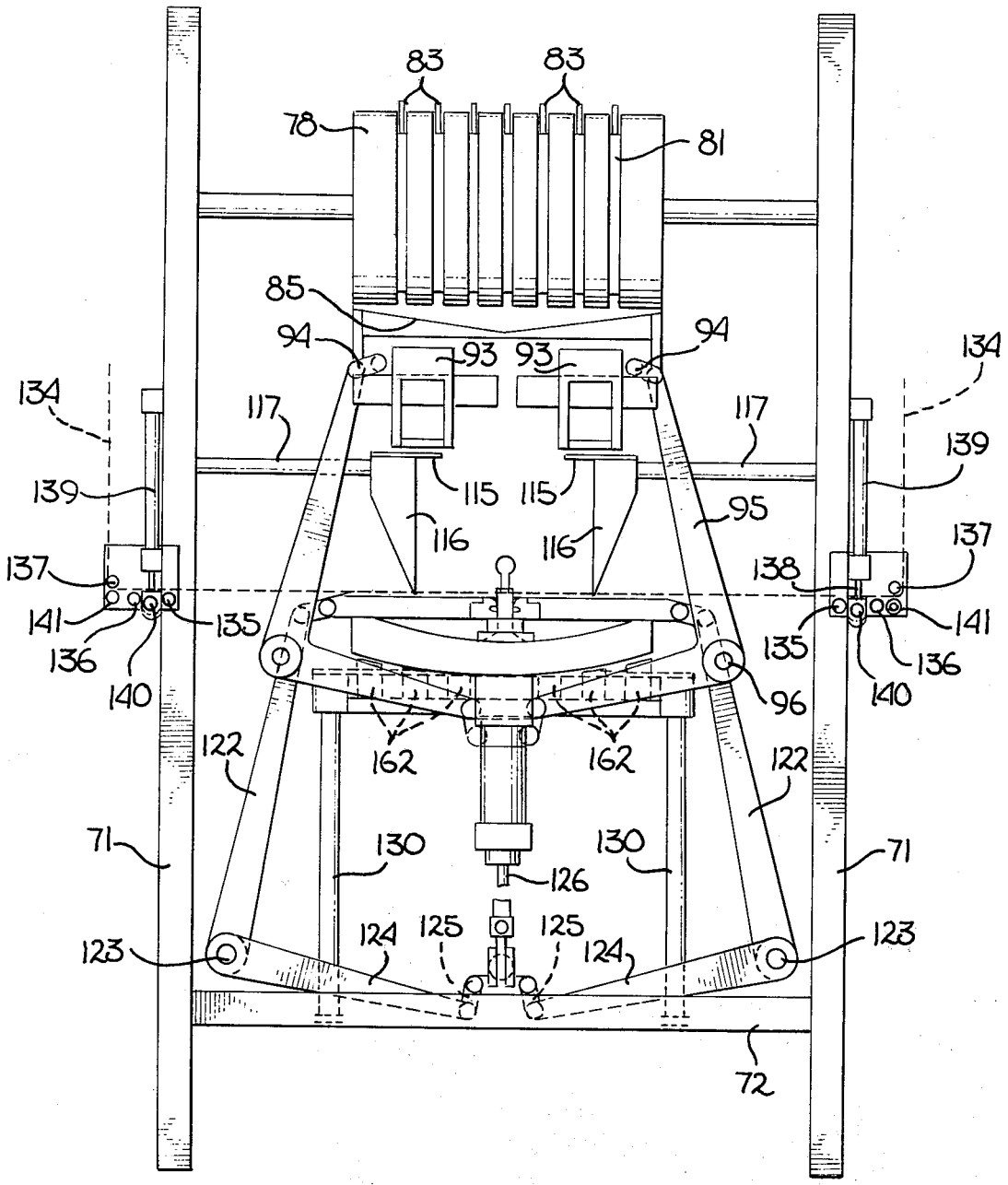
FIG. 5 is a schematic side elevation of the device shown in FIG. 4, some parts being omitted for the sake of clarity.

The device shown in FIGS. 4 and 5 comprises a frame having vertical beams 71 and horizontal beams 72 interconnecting said vertical beams 71.

To the beams 71 are secured bearings for holding rollers 73 and 74 for guiding a plurality of adjacent endless conveyor belts 75. A number of adjacent conveyor belts 76, the upper runs of which co-operate with the lower runs of the conveyor belts 75 are, passed around a roller 77 located beneath the roller 74, around a drum 78 located near the roller 73, around relatively independently adjustable stretching rollers 79 and around a guide roller 80.

The drum 78 is provided with grooves 81 in between the belts 76. Beneath the roller 73 the frame holds a horizontal shaft 82, to which a plurality of fingers 83 are fastened.

From the position of the fingers 83 shown in full lines in FIG. 4, in which the curved edges of the fingers 83 facing the drum 78 extend concentric to and at a given distance from the outer surface of the drum 78, the fingers can be turned by means of the shaft 82 into a position shown in broken lines, in which position the upper edges of the fingers are at least substantially in the line with the upper runs of the belts 76.

As will be seen from FIG. 4, a guide plate 84, extending concentric to the axis of rotation of the drum 78, is arranged at a short distance from the portion of the drum 78 surrounded by the belts 76, said plate terminating near the lowermost point of the drum in a slightly downwardly inclined delivery plate 85 having a substantially V-shaped section (FIG. 5). Since the stretching rollers 79 of the various belts 76 are relatively independently adjustable, it can be ensured that the various belts 76 all extend along the surface of the substantially V-shaped delivery plate 85.

Opposite the portion of the drum 78 surrounded by the belts 76 guide rollers 86 are adapted to co-operate with the belts 76 and to be driven by the belts 76.

The figure shows furthermore that relatively co-operating, superjacent feeding belts 89 and 90 are adjustable in a direction of height with the aid of two intermediate belts 87 and 88 pivotally coupled with the belts 75 and 76.

Beneath the conveyor belts 76 two collecting plates 91 are coupled with a suspension block 93 so as to be pivotable near one end about a horizontal shaft 92. The suspension blocks 93, adapted to slide along supports extending parallel to the shafts 92, are pivoted by means of coupling members 94 to the ends of arms of angle-levers 95, which are adapted to turn about shafts 96 extending horizontally and at right angles to the shafts 92. The free ends of the other arms of the angle-levers are pivoted with the aid of coupling members 97 to a setting cylinder 98 arranged in the frame. It will be obvious that a displacement of the piston rod 99 of the setting cylinder 98 in its direction of length results in a turn of the angle-levers 95 and hence a movement of the suspension blocks 93 with the collecting plates 91 secured thereto away from or towards one another.

The collecting plates 91 are adapted to turn about the horizontal shafts 92 out of the position indicated by solid lines in FIG. 4 into the position shown by broken lines in FIG. 4 with the aid of a setting cylinder 100, the piston rod 101 of which co-operates with a bracket 103 adapted to turn about a shaft 102 extending parallel to the shafts 92 above the latter. When the bracket 103 is turned downwards by means of the setting cylinder 100 it comes into contact with the rollers 104 fastened to the collecting plates 91, which plates are thus turned upwards into the position indicated by broken lines. Then lock bolts 105 grip automatically behind parts of the collecting plates 91 so that the latter are retained in the position indicated by broken lines and the setting cylinder 100 can return into its initial position without the collecting plates 91 turning back.

Unlocking the lock bolts 105 can be achieved by means of a bracket 106 pivoted to the frame and connected with the piston rod 107 of a setting cylinder 108 fastened to the frame. An angle-lever 110 is coupled with the piston rod so as to be rotatable about a shaft 109 fastened to the frame. A roller 111 fastened to the free end of the angle-lever co-operates with a rotatable cam disc 112.

Above the collecting plates 91 guide plates 113 extend upwardly and are coupled with the frame so as to be rotatable about shafts 114 extending parallel to the shafts 92 so that the plates 113 can turn up and down together with the plates 91. The plates 113, however, do not move with the plates 91 away from or towards one another.

Beneath the collecting plates two horizontal plates 115 have fastened to them plates 116 extending vertically downwards. The plates 116 are located at a given distance from the proximal edges of the aligned, horizontal plates 115. The sets of the plates 115 and 116 adapted to slide away from and towards one another along horizontal guide bars 117 fastened to the frame with the aid of a setting cylinder 118, which is connected by cables with the plate sets 115, 116.

At the level of the lower ends of the vertical plates 116 two aligned, horizontal storage portion plates 119 are slidable along guide rods 120 arranged in the frame.

The distal edges of the storage portion plates 119 are pivoted by means of coupling members 121 to arms 122, which are fastened to shafts 123 journalled in the frame. The shafts 123 have furthermore secured to them arms 124, which are pivoted by means of coupling members 125 to the piston rod 126 of a setting cylinder 127.

Above the setting cylinder 128 is arranged a setting cylinder 128. One end of the piston rod 129 projecting out of the cylinder 128 is rigidly secured to the frame. The stroke of the setting cylinder 128 is materially smaller than that of the cylinder 127 and it will be obvious that with the aid of the setting cylinder 127 and/or the setting cylinder 128 a displacement of the two storage portion plates 119 away from or towards one another can be performed.

Beneath the storage portion plates 119 a table 162, corresponding with the table 44 of the preceding embodiment, is arranged so as to be displaceable up and down along vertical guide bars 130. For displacing the table 162 the end of a piston rod 163 of a setting cylinder 131 is coupled with the table. At the top side of the setting cylinder 131 a setting cylinder 132 is fastened, which is provided with a piston rod 133, the end of this rod projecting out of the cylinder being connected with the frame.

In order to guide tapes 134 supplied from reels (not shown) three guide rollers 135, 136 and 137 are provided for each tape near one side of the frame (see FIG. 5). Between the two guide rollers 135 and 136, located at the same level, is movably arranged a roller 140 fastened to the end of a piston rod 138 of a setting cylinder 139. Beneath the rollers 137 guide rollers 141 are arranged so that the tapes are fed in between the rollers 137 and the rollers 141. At the circumference the guide rollers 141 are provided with inflatable hoses so that, when the hoses are blown, the tapes 134 can be clamped tight between the rollers 137 and 141.

Beneath the table 162, adapted to move up and down, a plurality of strips 142 extend vertically upwards and are secured to a support 143, which is slidable along horizontal guide bars 144 with the aid of a setting cylinder 145 and a cable transmission. The strips 142 can be reciprocated with the aid of the setting cylinder 145 between the position shown in FIG. 4 by solid lines, in which the strips are in contact with a delivery table 146 and a position indicated on the right-hand side in FIG. 4 by broken lines.

The device shown in FIGS. 4 and 5 operates as follows. From a machine producing the objects, particularly bags, to be bundled, the bags are fed by means of the conveyor belts 89 and 90 and displaced between the relatively cooperating conveyor belts 75 and 76 towards the fingers 83. When the fingers 83 are in the position shown by broken lines, the bags are passed in between the fingers and the upper conveyor belts 75 (see FIG. 4) to the left without being passed across the bundling device. However, when the fingers are in the position indicated by solid lines, the bags are moved between the parts of the belts 76 surrounding the drum 78 and the guide plates 84, whilst the rollers 86 co-operating with the belts 76 ensure a regular displacement of the bags.

Owing to the curved shape of the delivery plate 85 the bags are also bent over slightly in the shape of a V, which imparts some degree of rigidity to the bags so that they will not bend down during the further movement to the collecting plates 91.

By using the drum 78 the bags are inverted, which is important to avoid that overlaps of bags slip into one another, which would render a regular order of the bags impossible.

Initially the collecting plates 91 will be in the position indicated by solid lines so that the bags or the like drop on the plates and pass into the storage portion bounded by said plates on the bottom side and by the plates 113 on the sides.

When a given number of bags or the like is fed to the collecting plates 91, the cylinder 98 is actuated by means of a control-mechanism, so that the collecting plates 91 move away from one another and the bags drop down on the collecting plates 115 bounding a further storage portion on the bottom side. The plates 113 prevent a lateral displacement of the bags accumulated on the collecting plates 91, when the latter are moving away from one another. The additionally supplied bags will then drop directly on the pile of bags deposited on the plates 115.

As soon as the collecting plates 91 have attained their extreme position, the setting cylinder 100 is enabled to turn up the plates 91 into the position indicated by broken lines, in which the plates are retained by means of the lock bolts 105. Then the piston rod of the setting cylinder 100 is again withdrawn and the plates 91 are moved towards one another by means of the setting cylinder 98.

At the next-following counting pulse from the counting disc, the cylinder 108 is actuated to draw up the piston rod 107. Thus the cam roller 111 is urged by the angle-lever 110 against the periphery of the cam disc 112. The counting mechanism is adjusted so that this upwards movement of the piston rod 107 takes place when the cam roller 111 is opposite the elevated part of the cam disc 112 so that the piston rod 107 can initially move upwards only over a very small distance. The cam disc 112 is driven from the bag-producing machine and at the instant when the cam roller 111 moves from the high part to the lower part of the cam disc 112, the piston rod 107 will be withdrawn further so that the lock bolts 105 are released and at the desired instant the collecting plates 91 are turned downwards for interrupting the feed of further bags or the like to the pile lying on the plates 115. Immediately after the collecting plates 91 have been turned by springs (not shown) into the position indicated by solid lines, the setting cylinder 118 is enabled for moving the horizontal plates 115 away from one another so that the bags will drop on the tapes 134 lying on the adhering plates 119, the proximal ends of the tape being adhered to one another. Immediately after the bags have dropped down, the plates 115 are moved back by means of the setting cylinder 118, the bags being orientated by means of the plates 116. The distance between the plates 116 in their most adjacent position is so that the bags just fit in between them.

If desired the machine may be adjusted so that the feed of bags to the two plates 119 is repeated several times before the bundling mechanism proper is actuated.

When the desired number of bags is deposited in the storage portion bounded by the plates 116, the cylinder 127 is enabled for moving the storage portion plates 119 away from one another. As a result the bags drop onto the spaced arms forming the table 162, whilst the parts of the tapes 134 lying below the bags are carried along. Subsequently the cylinders 131 and 132 are actuated for moving down the table 162, so that the two tapes 134 will hand down in a large loop between the two spaced storage portion plates 119. When the table 162 has reached its lowermost position, the cylinder 127 is again actuated for moving the two storage portion plates 119 towards one another. At the end of the stroke of the setting cylinder 127 the proximal edges of the storage portion plates 119 are still at a distance of about 5 mms from one another. Then the cylinders 131 and 132 are again actuated for moving the table 162 upwards so that the bags lying on the table are urged against the bottom side of the storage portion plates 119, whilst they are slightly curved about their longitudinal axis, which is indicated schematically in the figure. During the upward movement of the table 162 with the bundle of bags lying on it air is admitted into the hoses around the guide rollers 141 in order to clamp the tapes 134 tightly between the guide rollers 137 and 141, whilst at the same time the piston rods 138 carrying the guide rollers 140 are moved down in order to stretch the tapes 134 in a suitable manner around the bunch of bags.

When the tapes 134 surround the bags with the correct stress, which can be achieved by using an appropriate pressure control-valve for the cylinders 139, the cylinder 128 is actuated for approaching the adhering plates further towards one another so that the edges of the adhering plates come into contact with one another and the filament wire enclosed therein can be enabled for adhering and cutting the tapes 134.

When the tapes 134 are adhered to one another, the pressure in the clamping hoses of the guide rollers 141 is eliminated and the full operative pressure is allowed to build up in the cylinders 139 in order to urge the guide rollers 140 further down for the supply of further lengths of tapes 134. Subsequently, the setting cylinders 139 are returned to their initial positions.

When the tapes are adhered to one another the strips 142 are moved to the position indicated by broken lines in FIG. 4. After the tapes are adhered together, the setting cylinder 128 is actuated again for moving the storage portion plates 119 slightly away from one another, whilst with the aid of the setting cylinder 131 the table 162 is moved to the same level as the delivery table 146. With the aid of the setting cylinder 145 the strips 142 are now moved to the left (see FIG. 4) into the position indicated by solid lines, whilst the ends of the strips 142 extending through the interstices between the arms of the table 162 push the bundle of bags from the table 162 onto the table 146. After the bundle of bags is pushed away from the table 162, the latter is returned to its initial position by means of the setting cylinder 131. Then the whole cycle can be repeated. As a matter of course, a suitable controlmechanism is provided to ensure that all movements are performed in the correct order of succession.

Since in this embodiment the collecting plates 91 are in a substantially horizontal position, the bags drop down during reeding over a comparatively small height so that a more regular movement of the bags is ensured. When the collecting plates 115 are employed, a fairly small height of drop is ensured whilst it is furthermore possible to vary the number of bags to be collected in one bundle in a simple manner by feeding bags once or several times by opening and closing the collecting plates 115 prior to the actuation of the bundling mechanism proper. Also the delivery of the bags is performed by simple means and the delivery table may be arranged at a comparatively high level, which facilitates any further mechanical treatment of the bags.

With the aid of the fingers 83 the bags can be delivered directly without passing across the bundling device, which may be important at the start and the adjustment of the bag-producing machine, since at the start unsuitable bags may be produced. Also for a check during the manufacturing process bags may be delivered eventually with the aid of the fingers.

Figure 6:
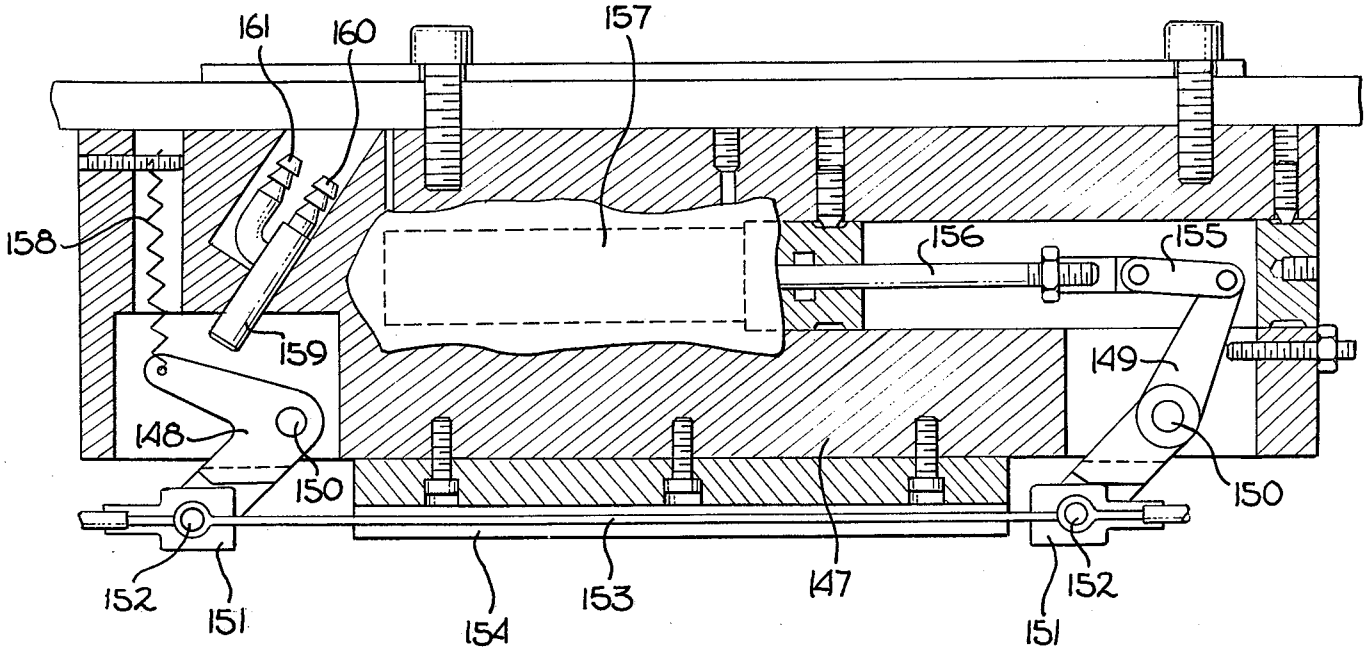
FIG. 6 is a sectional plan view of the adhering mechanism.

A particularly effective mechanism for adhering the tapes 134 to one another is shown in FIG. 6. In this embodiment the edge of an storage portion plate facing the other storage portion plate is formed by a housing 147, in which two anglelevers 148 and 149 are adapted to turn about vertical shafts 150. By means of insulating blocks 151 and vertical shafts 152 the ends of a filament wire 153 are coupled in the manner shown with the angle-levers 148 and 149. In the position shown the filament wire 153 is located over the major part of its length in a groove 154.

The angle-lever 149 is pivoted by means of a coupling member 155 to the end of a piston rod 156 of a setting cylinder 157 arranged in the housing 147.

With the other angle-lever 148 is coupled a spring 158 for stretching the wire. The housing comprises furthermore a blower nozzle 159, to which air can be supplied through a duct 160, whilst the pressure in the nozzle can be branched through a duct 161.

In operation air is blown out of the nozzle 159.

When the tapes 134 have to be fastened to one another, current is passed through the filament wire 153 so that the temperature rises. As a result, the wire 153 becomes longer so that the lever 148 will turn under the action of the spring 158 in a clockwise direction (see FIG. 6) about the shaft 150. One arm of the angle-lever 148 thus approaches the opening of the nozzle 159 so that the resistance against the air stream is increased and the pressure in the duct 161 increases.

When a given pressure in the duct 161 is attained, a switch is actuated for cutting off the current supply to the wire 153. At the instant of cut-off of the current supply the setting cylinder 157 is actuated for turning the angle-lever 149 on anti-clockwise direction (see FIG. 6). The wire 153 is thus urged out of the groove 154 and moved towards the other storage portion plate 119 so that the wire 153 passes across the tape portions 134 compressed above the adhering plates, the tapes being thus welded to one another and being cut through approximately at the centre of the weld. As soon the tapes have been welded together, the wire 153 is returned by means of the setting cylinder 157 to the position shown in FIG. 6.

I claim:

1. A bundling machine for flat flexible objects which comprises:

a frame;

a pair of horizontally slideable portions within said frame defining the bottom of a storage space;

tape guiding means for guiding a pair of tapes across the bottom of said storage space, the ends of said tapes being adhered one to the other;

means for delivering a plurality of said objects to said storage space forming a pile of objects;

means for causing said slideable portions to move apart allowing said pile of objects to move downward and including means for moving said slideable portions together again over said pile of objects causing said tapes to form a loop around said pile of objects;

adhering and severing means for severing said loop from said tapes, adhering the ends of said loop, whereby said pile of objects is bundled, and adhering the ends of said severed tapes; and clamping means for clamping said pile of objects against the bottom of said slideable portions before the ends of said loop are adhered.

2. The bundling machine of claim 1 and further including tape tensioning means for tensioning the tape in said loop before the ends of said loop are adhered.

3. The bundling machine of claim 2 wherein said tape tensioning means includes spring loaded roller means, said roller means being actuated by said clamping means.

4. The bundling machine of claim 2 wherein said tape tensioning means includes yieldable guide means, said yieldable guide means adapted to yield when tension in said tapes increases.

5. The bundling machine of claim 2 wherein said tape tensioning means includes a pneumatic setting cylinder for applying tension to said tapes.

6. The bundling machine of claim 1 and further including a pair of collector plates for collecting objects being delivered to said bundling machine while a pile of objects is being bundled.

7. The bundling machine of claim 6 and further including counting means for initiating a bundling cycle.

8. The bundling machine of claim 7 wherein said counting means is driven by the device manufacturing said objects.

9. The bundling machine of claim 7 and further including: a setting cylinder actuable by said counting means; cam and roller means actuated by said setting cylinder; and lock bolts for holding said collector plates in their non-collecting position, said lock bolts being releaseable by said cam and roller means.

10. The bundling machine of claim 7 wherein said collector plates are adapted for motion toward and away from each other whereby objects collected on said collector plates may be released to said storage space.

11. The bundling machine of claim 1 and further including conveyor means comprised of a plurality of substantially parallel spaced belts, said clamping means being comprised of a plurality of spaced arms forming a table and adapted to move downward between said belts whereby a bundle of objects on said table will be delivered to said conveyor means.

12. The bundling machine of claim 1 wherein said clamping means is formed by a plurality of parallel arms adapted to be moved downward between a plurality of upward extending stripes, said upward extending strips being movable horizontally to deliver a bundle of objects from said machine.

13. The bundling machine of claim 10 and further including a second pair of collector plates, said second pair of collector plates being movable horizontally with respect to each other.

14. The bundling machine of claim 13 wherein said second pair of collector plates move responsive to the number of objects delivered thereto.

15. The bundling machine of claim 13 and further including a vertical plate depending from each of said second pair of collector plates into said storage space.

16. The bundling machine of claim 1 and further including a pair of endless conveyor belts disposed one above the other and adapted to convey said objects toward said storage space.

17. The bundling machine of claim 16 and further including two guide plates disposed one above the other for guiding objects passing between said conveyor belts to said storage space.

18. The bundling machine of claim 17 and further including a guide wire extending obliquely from the upper of said two guide plates toward said storage space.

19. The bundling machine of claim 16 wherein said conveyor belts are driven from a machine manufacturing said objects.

20. The bundling machine of claim 16 and further including a drum for inverting the objects delivered by said conveyor belts.

21. The bundling machine of claim 20 wherein each of the belts comprising said conveyor belt is comprised of a plurality of adjacent belts and further including pivotable fingers between said adjacent belts whereby said objects may be directed over said drum to said storage space or may be diverted and ejected from said machine.

22. The bundling machine of claim 1 wherein the clamping surface of said clamping means is curved.

23. The bundling machine of claim 1 and further including a wire filament adapted to be electrically heated and movable to sever said tapes, the severed end of each of said tapes being adhered to the other of said tape end respectively.

* * * * *